US009784502B2

(12) United States Patent
Tiernan et al.

(10) Patent No.: US 9,784,502 B2
(45) Date of Patent: Oct. 10, 2017

(54) SOLID FUEL SKEWER SUSPENSION BURNING SYSTEM

(71) Applicant: AFS Technology, LLC, Tipp City, OH (US)

(72) Inventors: John J. Tiernan, Huber Heights, OH (US); Allen G. Bowman, Riverside, OH (US)

(73) Assignee: AFS TECHNOLOGY, LLC, Tipp City, OH (US)

( * ) Notice: Subject to any disclaimer, the term of this patent is extended or adjusted under 35 U.S.C. 154(b) by 372 days.

(21) Appl. No.: 14/477,923

(22) Filed: Sep. 5, 2014

(65) Prior Publication Data

US 2014/0377037 A1 Dec. 25, 2014

Related U.S. Application Data

(63) Continuation of application No. PCT/US2013/028990, filed on Mar. 5, 2013.
(Continued)

(51) Int. Cl.
*F27D 3/00* (2006.01)
*F23G 5/44* (2006.01)

(52) U.S. Cl.
CPC ..... *F27D 3/00* (2013.01); *F23G 5/444* (2013.01); *F23G 2203/803* (2013.01);
(Continued)

(58) Field of Classification Search
CPC ..... F23G 5/444
(Continued)

(56) References Cited

U.S. PATENT DOCUMENTS 3,946,680 A 3/1976 Laman
4,030,984 A 6/1977 Chambers
(Continued)

FOREIGN PATENT DOCUMENTS

CN 1276057 A 12/2000
CN 1060263 C 1/2001
(Continued)

OTHER PUBLICATIONS

Zhao Mingyan; Chinese Office action dated Jan. 29, 2015 for Chinese patent application No. 201180055076.9; State Intellectual Property Office of the People's Republic of China; and Text Portion of the Notification of the First Office Action in English.
(Continued)

*Primary Examiner* — Jonathan Snelting
(74) *Attorney, Agent, or Firm* — Thomas E. Lees, LLC

(57) ABSTRACT

A solid fuel skewer suspension burning system for a kiln, comprises a skewer rod and a solid fuel loading system. The skewer rod has a first end and a length that extends longitudinally. The solid fuel loading system includes a fuel centering and staging area that receives fuel from a conveyor system, and a fuel loading area that receives fuel from the fuel centering and staging area. The solid fuel is inserted upon the skewer rod at the fuel loading area. The solid fuel loading system also includes a first clamp, an airlock and a plow. The first clamp holds the skewer rod and defines a first position between the first clamp and a free end of the skewer rod. The airlock is spaced from the first clamp and has a first airlock gate and a second airlock gate. The plow reciprocates substantially longitudinally in cooperation with the skewer rod to advance fuel along at least a portion of the length of the skewer rod.

20 Claims, 11 Drawing Sheets

Related U.S. Application Data

(60) Provisional application No. 61/606,592, filed on Mar. 5, 2012.

(52) U.S. Cl.
CPC .... *F23G 2205/101* (2013.01); *F23G 2205/18* (2013.01); *F23G 2209/281* (2013.01); *F23K 2203/203* (2013.01)

(58) Field of Classification Search
USPC ..... 414/152
See application file for complete search history.

(56) References Cited

U.S. PATENT DOCUMENTS

| | | | |
|---|---|---|---|
| 4,295,823 | A | 10/1981 | Ogawa et al. |
| 4,551,051 | A | 11/1985 | Hofbauer et al. |
| 4,850,290 | A | 7/1989 | Benoit et al. |
| 5,078,594 | A | 1/1992 | Tutt et al. |
| 5,101,739 | A | 4/1992 | Nance et al. |
| 5,122,189 | A | 6/1992 | Garrett et al. |
| 5,224,433 | A | 7/1993 | Benoit et al. |
| 5,339,751 | A | 8/1994 | Tutt |
| 5,445,087 | A | 8/1995 | Kaneko |
| 5,473,998 | A | 12/1995 | Allen et al. |
| 5,730,073 | A | 3/1998 | Kobata |
| 5,806,442 | A | 9/1998 | Aldred et al. |
| 5,816,795 | A | 10/1998 | Hansen et al. |
| 5,989,017 | A | 11/1999 | Evans |
| 6,210,154 | B1 | 4/2001 | Evans et al. |
| 6,213,764 | B1 | 4/2001 | Evans |
| 6,345,981 | B1 | 2/2002 | Hansen et al. |
| 6,875,015 | B1 | 4/2005 | Tiernan |
| 8,757,071 | B2 | 6/2014 | Tiernan et al. |
| 2002/0017226 | A1 | 2/2002 | Largent |
| 2006/0169181 | A1 | 8/2006 | Youn et al. |
| 2006/0254482 | A1 | 11/2006 | Kohnen |
| 2007/0295248 | A1 | 12/2007 | Kohnen et al. |
| 2009/0047102 | A1 | 2/2009 | Seirlehner et al. |
| 2009/0291403 | A1 | 11/2009 | Conti et al. |

FOREIGN PATENT DOCUMENTS

| | | | |
|---|---|---|---|
| CN | 1314983 | A | 9/2001 |
| CN | 2691824 | Y | 4/2005 |
| DE | 2343954 | A1 | 3/1975 |
| DE | 4447357 | A1 | 6/1996 |
| EP | 0568202 | A1 | 11/1993 |
| EP | 0803693 | A2 | 10/1997 |
| GB | 1345456 | | 1/1974 |
| GB | 2034014 | A | 5/1980 |
| GB | 2312494 | A | 10/1997 |
| JP | 5172322 | A | 7/1993 |
| JP | 7091633 | A | 4/1995 |
| JP | 8094044 | A | 4/1996 |
| WO | 9213245 | A1 | 8/1992 |
| WO | 2009/143402 | A2 | 11/2009 |
| WO | 2012048159 | A2 | 4/2012 |
| WO | 2013134186 | A1 | 9/2013 |

OTHER PUBLICATIONS

Zhao Mingyan; Chinese Office action dated Sep. 24, 2015 for Chinese patent application No. 201180055076.9; State Intellectual Property Office of the People's Republic of China; and Text Portion of the Notification of the Second Office Action in English.

Extended European Search Report dated Nov. 26, 2015 for European Patent Application No. 13757962.9; European Patent Office.

Notification Concerning Transmittal of International Preliminary Report on Patentability and Written Opinion of the International Searching Authority for PCT Application No. PCT/US2013/028990, filed Mar. 5, 2013; mailing date of Sep. 18, 2014; The International Bureau of WIPO, Geneva, Switzerland.

Notification of Transmittal of the International Search Report and the Written Opinion of the International Searching Authority for PCT Application No. PCT/US2011/055166, filed Oct. 6, 2011, mailing date of May 21, 2012, Korean Intellectual Property Office, Republic of Korea.

Notification Concerning Transmittal of International Preliminary Report on Patentability with Written Opinion of the International Searching Authority for PCT Application No. PCT/US2011/055166, filed Oct. 6, 2011, mailing date of Apr. 18, 2013, The International Bureau of WIPO, Geneva, Switzerland.

Notification of Transmittal of the International Search Report and the Written Opinion of the International Searching Authority for PCT Application No. PCT/US2013/028990, filed Mar. 5, 2013; mailing date of Jun. 4, 2013; Korean Intellectual Property Office, Republic of Korea.

U.S. Appl. No. 61/472,802, entitled "Solid Fuel Skewer Suspension Burning System", filed Apr. 7, 2011.

U.S. Appl. No. 61/390,822, entitled "Waste Derived Solid Fuel Skewer for a Fuel System of a Kiln", filed Oct. 7, 2010.

Jose Enrique Cazares Avila; Mexican Office Action dated Jul. 20, 2015 for Mexican patent application No. MX/a/2013/003851; Mexican Institute of the Industrial Property (IMPI); see p. 1 for cited reference.

SOLID FUEL SKEWER SUSPENSION BURNING SYSTEM

CROSS REFERENCE TO RELATED APPLICATIONS

This application is a bypass continuation of International Application No. PCT/US2013/028990, filed Mar. 5, 2013, entitled "SOLID FUEL SKEWER SUSPENSION BURNING SYSTEM", which claims the benefit of U.S. Provisional Patent Application Ser. No. 61/606,592, filed Mar. 5, 2012, entitled "SOLID FUEL SKEWER SUSPENSION BURNING SYSTEM", the disclosures of which are hereby incorporated by reference.

BACKGROUND

Various aspects of the present invention relate generally to fuel delivery systems for a kiln such as a cement kiln or lime kiln, and more particularly, to a skewer for the handling of whole tires in the fuel system of a kiln.

Cement is a fine-powdered binding substance that sets when mixed with water to bind sand, gravel and other components into concrete. In general, cement is comprised of two components, including clinker and gypsum. Clinker is produced in a cement kiln by heating raw materials including calcium, silica, alumina, iron and small amounts of various admixtures to a sintering temperature. The resulting clinker exits the kiln in small clumps. Gypsum is mixed with the clinker to serve as a setting additive and to facilitate grinding of the clinker into the powdered form of cement.

Several different production processes are known for manufacturing clinker in cement kilns. For instance, cement kilns may be "long dry" or "long wet". In both cases, the raw materials required to manufacture clinker are crushed and mixed together. In a wet process, the raw material is further mixed with water into a slurry. In each process, the raw material is fed into a long rotary kiln. As the kiln rotates, the raw material is passed from one end of the kiln to the other. The temperature inside the kiln causes the material to undergo chemical changes including calcining and eventually sintering into irregularly shaped clumps. The clumps of clinker are cooled and are ground up in subsequent processes. For instance, the ground up clinker is mixed with gypsum to produce cement, as noted above.

The heating of the kiln contributes to a significant portion of the energy required to operate a cement kiln. As such, the production processing of modern kilns has been modified from conventional long wet and long dry kilns to improve energy efficiency by using a preheater to preheat the raw material before introducing the raw material into the rotary kiln. In early preheater technologies, a riser duct having one or more cyclones feeds the entrance of the rotary portion of the kiln. Essentially, the raw material falling through the preheater to the rotary kiln is heated by the exhaust gas that normally escapes from the kiln. An extension of the preheater is the precalciner kiln. In this kiln technology, the preheater efficiency is improved by installing a second heat source in the riser duct.

BRIEF SUMMARY

According to aspects of the present disclosure, a solid fuel skewer suspension burning system for a kiln comprises a skewer rod and a solid fuel loading system. The skewer rod has a first end and a length that extends longitudinally. The solid fuel loading system includes a fuel centering and staging area that receives fuel from a conveyor system. The solid fuel loading system also includes a fuel loading area that receives fuel from the fuel centering and staging area. The solid fuel is inserted upon the skewer rod at the fuel loading area. The solid fuel loading system still further includes a first clamp, an airlock and a plow. The first clamp holds the skewer rod and defines a first position between the first clamp and a free end of the skewer rod. The airlock is spaced from the first clamp and has a first airlock gate and a second airlock gate. The plow reciprocates substantially longitudinally in cooperation with the skewer rod to advance fuel along at least a portion of the length of the skewer rod.

According to further aspects of the present disclosure, a solid fuel skewer suspension burning system for a kiln comprises a skewer rod, a solid fuel positioner, and a solid fuel loading system. The skewer rod has a free end and a length that extends longitudinally. The skewer positioner extends and retracts the skewer rod. The solid fuel loading system has a fuel centering and staging area that receives solid fuel from a conveyor system and a fuel loading area that receives solid fuel from the fuel centering and staging area, wherein fuel is loaded onto the free end of the skewer rod at the fuel loading area. The solid fuel skewer suspension burning system may also include a dislodging mechanism coupled to the skewer positioner that dislodges solid fuel from the skewer rod when the skewer positioner retracts the skewer rod.

BRIEF DESCRIPTION OF DRAWINGS

FIG. 3 illustrates tires loading on a conveyor, fuel centering and staging area, and a fuel loading area, according to aspects of the present disclosure;

FIG. 4 illustrates a tire being skewered by a skewer rod of the supported-end loaded system, according to aspects of the present disclosure;

FIG. 5 illustrates a group of tires advanced on a skewer rod past a first clamp to a second clamp by a first plow, according to aspects of the present disclosure;

FIG. 6 illustrates the group of tires advanced on the skewer rod past the second clamp to an airlock by the first plow, according to aspects of the present disclosure;

FIG. 7 illustrates the group of tires advanced on the skewer rod past the airlock to a fuel burning zone of a kiln, according to aspects of the present disclosure;

DETAILED DESCRIPTION

In typical cement and lime kilns, working temperatures typically exceed the temperature utilized by conventional incinerators. Moreover, cement and lime kilns have a high degree of air pollution controls already in place. Still further, limestone, a main ingredient of such kilns, can neutralize acids. As such, cement kilns and lime kilns are an excellent source for disposing of waste by burning the waste for fuel. Old tires have more energy per pound than coal, thus making tires an excellent fuel for kilns. For example an old tire can generate energy of 15,000 BTU per pound, whereas coal can only generate 12,000 to 13,000 BTU per pound. Thus, the burning of tires can be approximately 20% more energy-efficient than burning coal.

Various aspects of present disclosure relate to suspension burning systems that provide the ability to convert waste derived solid fuels such as old tires into energy as part of the heating system of kilns such as cement kilns and lime kilns. In this regard, skewer arrangements are provided that enable the complete incineration of whole tires while in suspension. Moreover, the skewer arrangements herein positively maintain the whole tires in suspension without allowing the tires to unintentionally fall into the kiln and are thus suitable for use in kiln preheater locations that exhibit high upward heated gas velocity, as will be described herein.

In this regard, the application herein incorporates by reference, in their entirety, the following:

PCT/US11/55166, entitled, "SOLID FUEL SKEWER SUSPENSION BURNING SYSTEM", filed Oct. 6, 2011;

U.S. Provisional Patent App. Ser. No. 61/472,802, entitled "SOLID FUEL SKEWER SUSPENSION BURNING SYSTEM", filed Apr. 7, 2011;

U.S. Provisional Patent App. Ser. No. 61/390,822, entitled "WASTE DERIVED SOLID FUEL SKEWER FOR A FUEL SYSTEM OF A KILN", filed Oct. 7, 2010; and U.S. Provisional Patent App. Ser. No. 61/606,592, entitled "SOLID FUEL SKEWER SUSPENSION BURNING SYSTEM", filed on Mar. 5, 2012.

Figure 1:
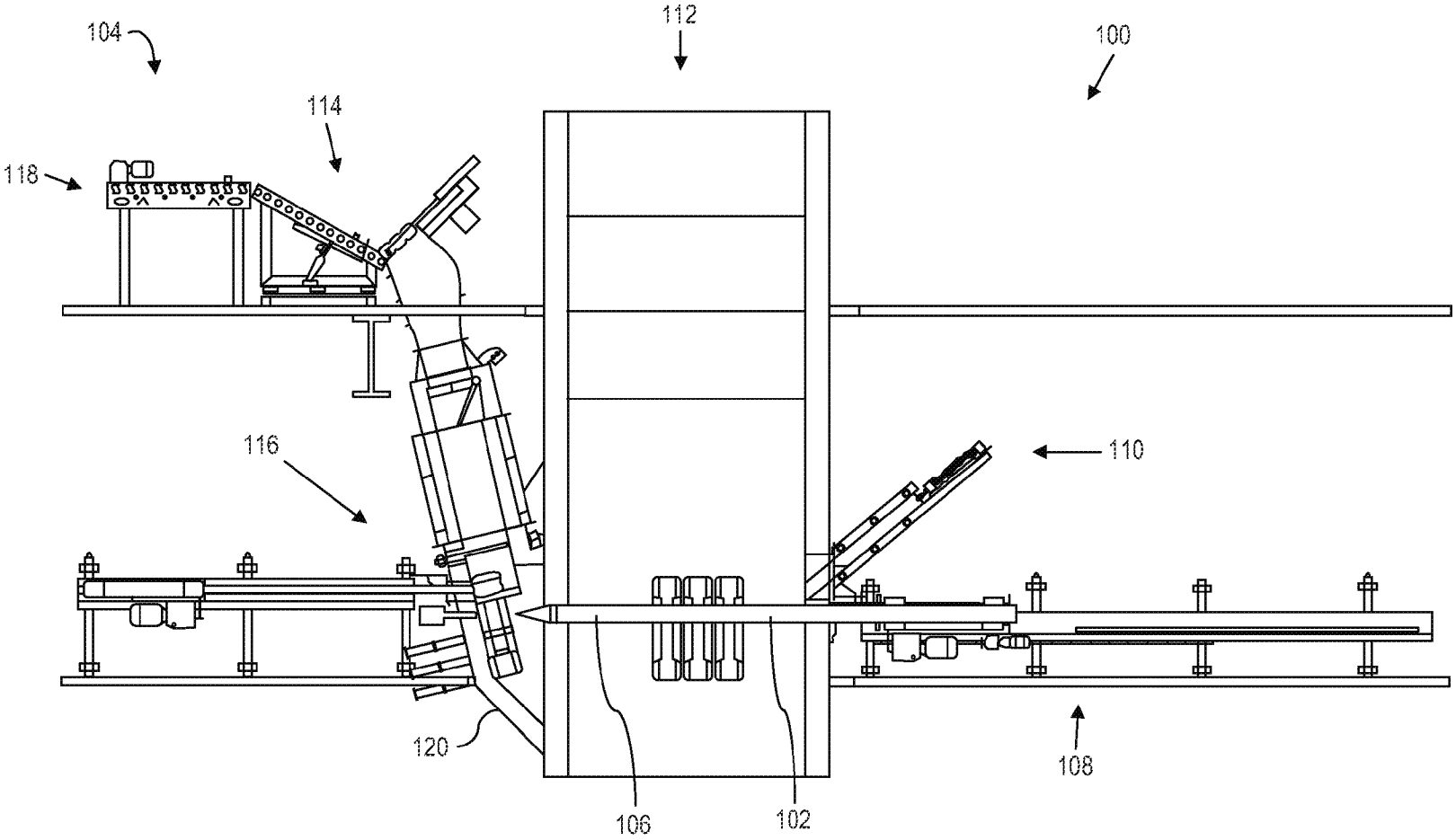
FIG. 1 is an illustration of an unsupported-end loaded solid fuel skewer suspension burning system, according to aspects of the present disclosure.

Referring now to the drawings, and in particular to FIG. 1, an unsupported-end loaded (UEL) solid fuel skewer suspension burning system 100 is illustrated according to aspects of the present disclosure. The UEL system 100 includes a skewer rod 102 and a solid fuel loading system 104, which loads solid fuel (e.g., tires) onto the skewer rod 102. The skewer rod 102 of the UEL system 100 includes a first end 106.

The UEL system 100 includes a skewer positioner 108 that extends and retracts the skewer rod 102. The skewer positioner 108 also serves as a support for the skewer rod 102. Moreover, the UEL system 100 includes a dislodging mechanism 110. During operation, the skewer positioner 108 extends the skewer rod 102 into a fuel burning zone 112. At times, the skewer positioner 108 may retract the skewer rod 106. Moreover, during operation, e.g., if needed, the dislodging mechanism 110 removes or repositions one or more tires on the skewer rod 106.

The solid fuel loading system 104 includes a fuel centering and staging area 114 and a fuel loading area 116. During operation, a conveyor system 118 transports solid fuel (e.g., tires) to the fuel centering and staging area 114, which coveys the solid fuel (e.g., tires) to the fuel loading area 116. At the fuel loading area 116, the tire is centered such that the hole of the tire is lined up on a same vertical line as the skewer rod 102. Movement of the tires from the conveyor system 118 to the fuel centering and staging area 114 to the fuel loading area 116 can be carried out under computer control (not shown) so as to regulate the feed rate of tires into the fuel burning zone 112.

In applications where tires are specifically used as a form of solid fuel, the term "fuel centering and staging area 114" is freely interchanged with "tire centering and staging area 114". Analogously, the term "fuel loading area 116" is freely interchanged with the "tire loading area 116" throughout this disclosure.

The fuel centering and staging area 114 is positioned above the fuel loading area 116 so the tire drops from the centering and staging area 114 to the fuel loading area 116. At that point, the hole of the tire should be lined up with the first end 106 of the skewer rod 102. Some minor adjustments to the position of the tire may be made at the fuel loading area 114 if needed as described below. Then, an actuated gate 120 pushes the tire onto the skewer rod 102. In the UEL system 100, the solid fuel loading system 104 is opposite of the skewer positioner 108.

The UEL system 100 is intended to be used in applications where the skewer rod 102 spans completely across the fuel burning zone 112, such as in a riser duct, or a narrow calciner. In certain implementations, the UEL system 100 may also be placed in a feed shelf hood, below the orifice of the riser, which should also be ideal for $NO_x$ reduction. However, the UEL system 100 can be positioned at any desired location so long as the skewer rod 102 is long enough to span the associated fuel burning zone 112. For instance the UEL system 100 may even find application in a large diameter calciner.

Figure 2:
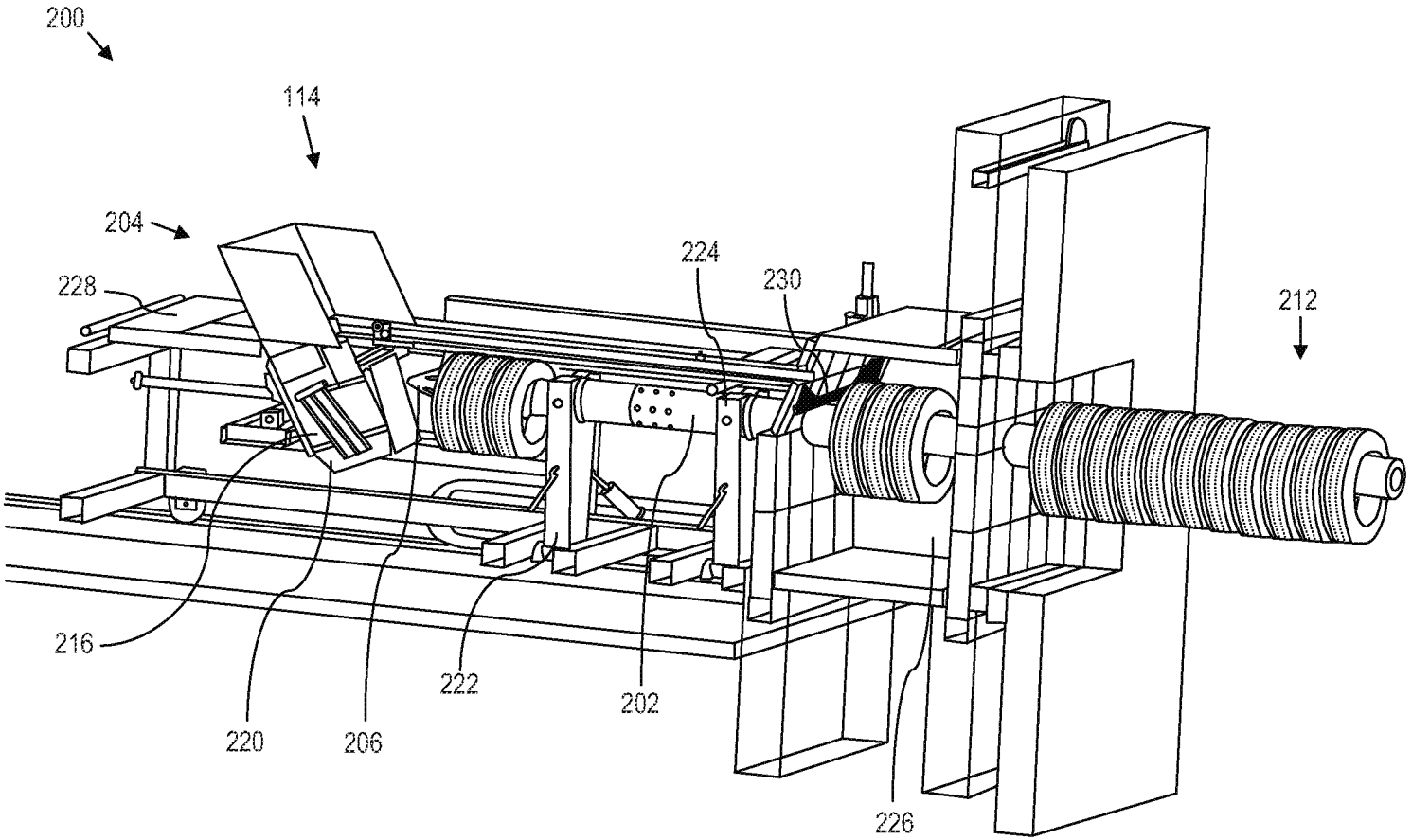
FIG. 2 is a cross-section view of a supported-end loaded solid fuel skewer suspension burning system, according to aspects of the present disclosure.

Referring to FIG. 2, a support-end loaded (SEL) solid fuel skewer suspension burning system 200 is illustrated, according to further aspects of the present disclosure. Similar to the UEL system (FIG. 1, 100) the SEL system 200 includes a skewer rod 202 and a solid fuel loading system 204. Further, the skewer rod 202 includes a first end 206 and a free end that extends into a fuel burning area 212 of a kiln. Also, the solid fuel loading system 204 includes a fuel centering and staging area 214 (shown in greater detail in FIG. 3) positioned above a fuel loading area 216. The fuel centering and staging area 214 feeds solid fuel (e.g., tires) to the fuel loading area 216 where an actuated gate 220 forces the tire onto the skewer rod 202.

In applications where tires are specifically used as a form of solid fuel, the term "fuel centering and staging area 214" is freely interchanged with "tire centering and staging area 214". Analogously, the term "fuel loading area 216" is freely interchanged with the "tire loading area 216" throughout this disclosure.

A first clamp 222 and a second clamp 224 support the skewer rod 202 at the first end of the rod 202. Moreover, the skewer rod 202 extends from the loading area 216 through an airlock 226 to the fuel burning zone 212. A first plow 228 runs the length of the skewer rod 202 to the airlock 226, and a second plow 230 runs the length of the skewer rod 202 that is inside the airlock 226. Optionally, the actuated gate 220 can serve as the first plow to push tires along the skewer rod 202. When the SEL system 200 is in operation, these plows 228, 230 advance the tires along the skewer rod 202 to the fuel burning zone 212.

In a manner analogous to that set out with regard to FIG. 1, movement of the tires from a conveyor system to the fuel centering and staging area 214 to the fuel loading area 216 can be carried out under computer control (not shown) so as to regulate the feed rate of tires into the fuel burning zone 212. The temperature of the fuel burning zone 212 and the length of the skewer rod 202 that is within the fuel burning zone 212 determine the fuel consumption per hour of the kiln. For example, if the temperature of the kiln burns a 9 kilogram (kg) tire (the average weight of a used car tire) in ninety seconds, then the burn rate for skewer rod 202 that holds five tires in the fuel burning zone 212 would support a burn rate of approximately 1.8 metric tons per hour (tons/hr). If an extension is added to the skewer rod 202 such that the rod can hold eight tires, then the approximate burn rate is three tons/hr. In another example, if the skewer rod 202 were lengthened with an extension to hold eleven tires in the fuel burning zone 212, then the burn rate would be approximately four tons/hr. Thus, the rate in which the conveyor feeds the fuel loading system is dynamically determined by the size of the tires being fed to the fuel loading system. Because the tires are around the skewer rod 202, the tires remain suspended in the fuel burning zone 212 regardless of upward pressure created in the kiln.

The SEL (Supported-End Loaded) system 200 is intended for applications where the skewer cannot reach across the fuel burning zone, such as in a large diameter calciner. In the SEL design, tires are advanced through a series of supports and airlock gates to the suspension burning end of the skewer in the calciner. However, the SEL system 200 is no so limited. Rather, the SEL system may find application in a riser duct, or a narrow calciner, in a feed shelf hood, below the orifice of the riser, etc., which should also be ideal for $NO_x$ reduction.

Figure 3:
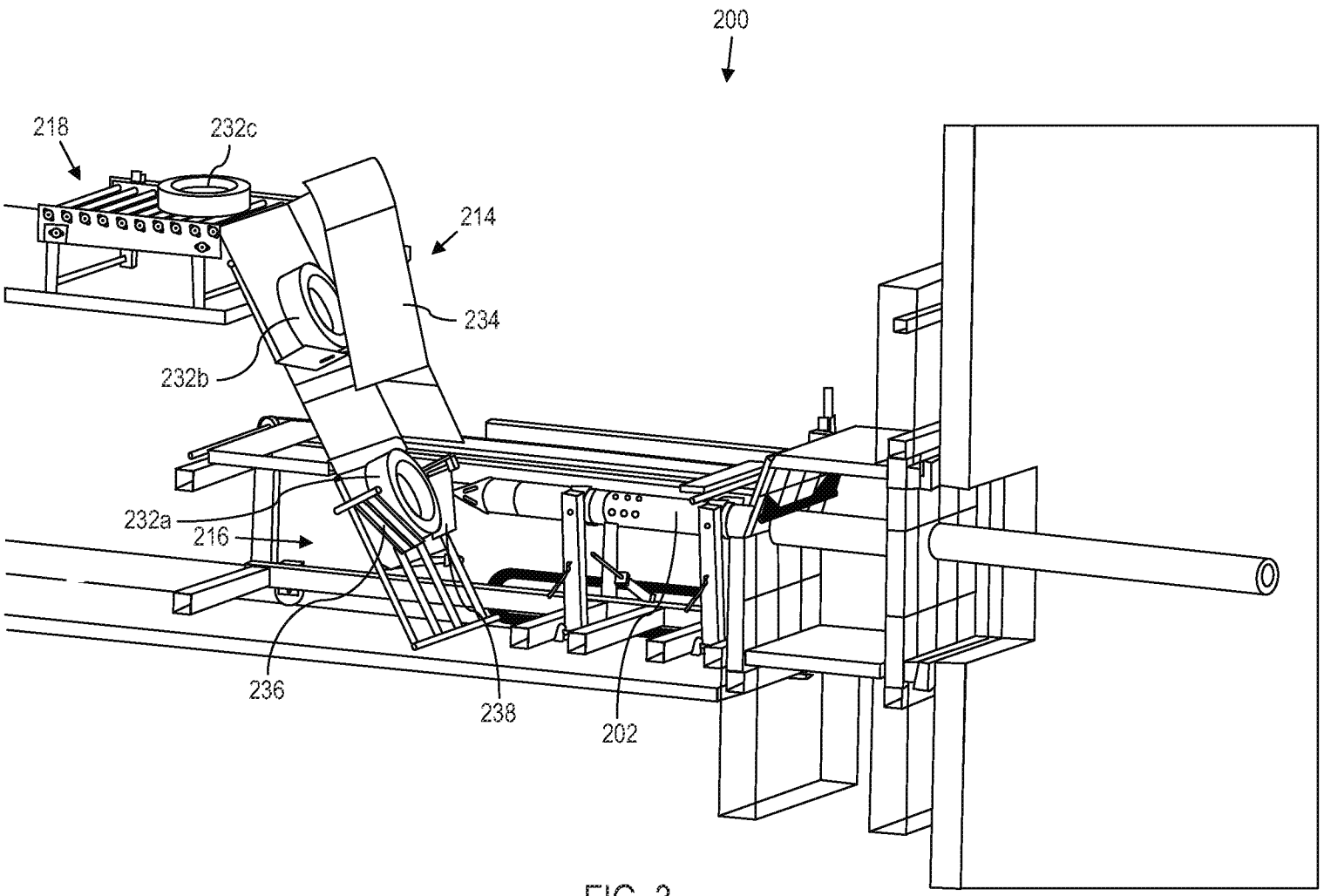
FIGS. 3-7 illustrate a sequence of steps for using a supported-end loaded solid fuel skewer suspension burning system, according to aspects of the present disclosure, in particular.

FIGS. 3-7 illustrate an exemplary process for supplying solid fuel to a fuel burning zone 212 using the SEL system 200 of FIG. 2. Referring specifically to FIG. 3, a SEL system 200 is illustrated, according to aspects of the present disclosure. In an initial stage of operation, tires 232*a-c* are loaded from a conveyor 218 into a tire centering and staging area 214. A first tire 232*a* has dropped from the tire centering and staging area 214 into a tire loading area 216, and as a second tire 232*b* falls from the conveyor 218 into the tire centering and staging area 214, a third tire 232*c* rests on the conveyor 218. The tire centering and staging area 214 further includes a shield 234 that prevents the tires 232 from bouncing from the tire centering and staging area 214 when loaded from the conveyor 218.

In the tire loading area 216, the first tire 232*a* is positioned vertically using a generally V-shaped structure with positioning flaps 236, 238 to ensure that the tire 232*a* is skewered properly. For example, if the tire 232*a* is smaller than an average tire, the positioning flaps 236, 238 will rotate inward, resulting in a larger angle between the two flaps 236, 238. Thus, the smaller tire 232*a* is raised so the skewer rod 202 fits easily through the hole in the tire. However, if the tire 232*a* is a larger tire, then the positioning flaps 236, 238 will rotate outward to let the larger tire 232*a* rest lower on the V-shaped structure so the skewer rod 202 fits easily through the hole in the tire.

Figure 4:
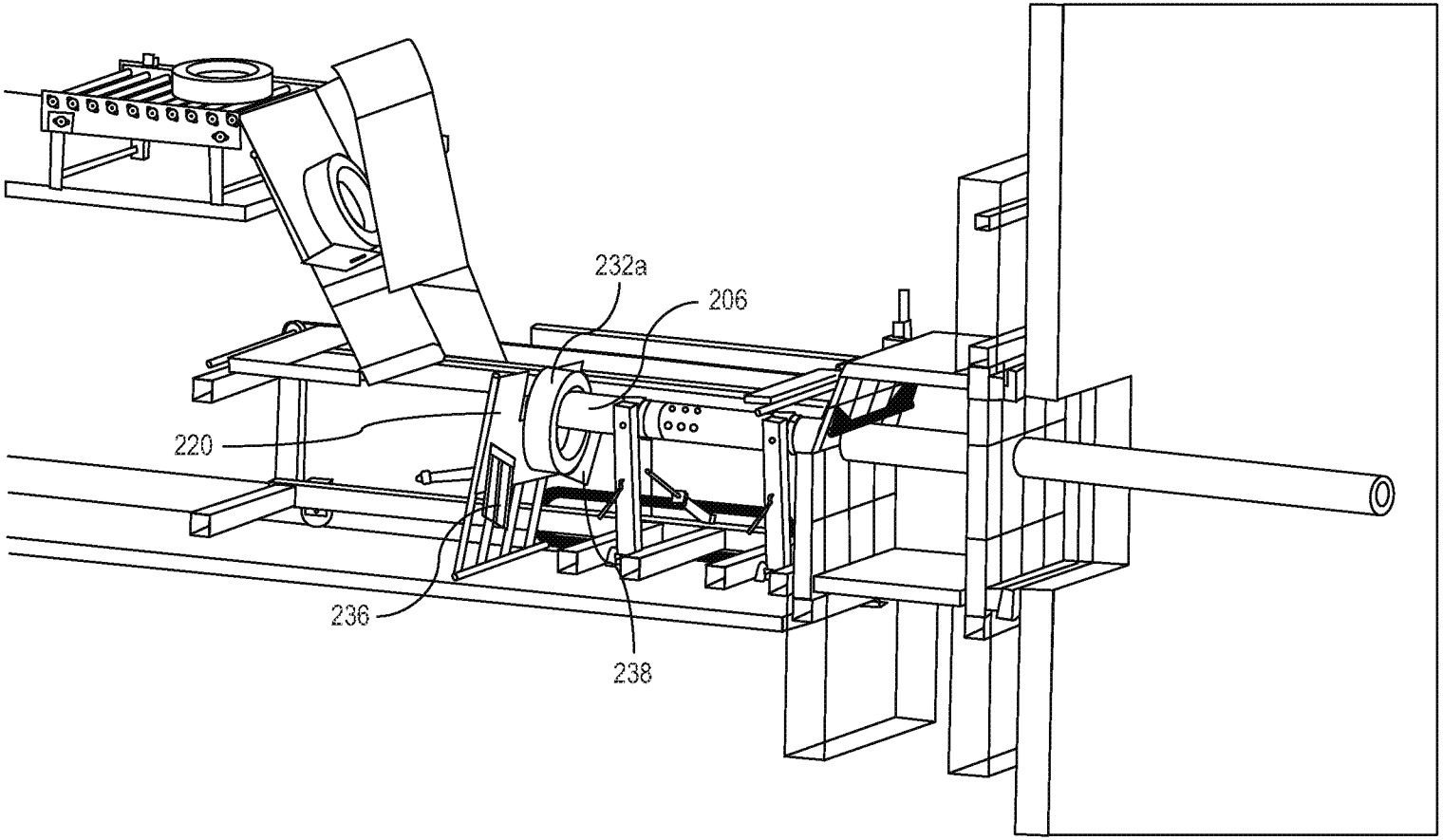

Referring to FIG. 4, the first tire 232*a* is skewered onto the skewer rod 202. More particularly, the tire loading area 216 positioned the center hole of the tire 232*a* to be received by the end of the skewer rod 202. Further, the gate 220 pivots forward to push the first tire 232*a* onto the skewer rod 202. As tires 232 are inserted onto the first end 206 of the skewer rod 202, the gate 220 serves to slide the tires along the skewer rod 202. As such, the gate 220 also serves as a short plow.

When the tire 232*a* is skewered, the positioning flaps 236, 238 rotate outward and allow the tire 232*a* to hang fully from the first end 206 of the skewer rod 202. This process can be repeated any number of times to load the skewer rod 202 with tires. In this example, three tires are skewered to form a tire group.

Figure 5:
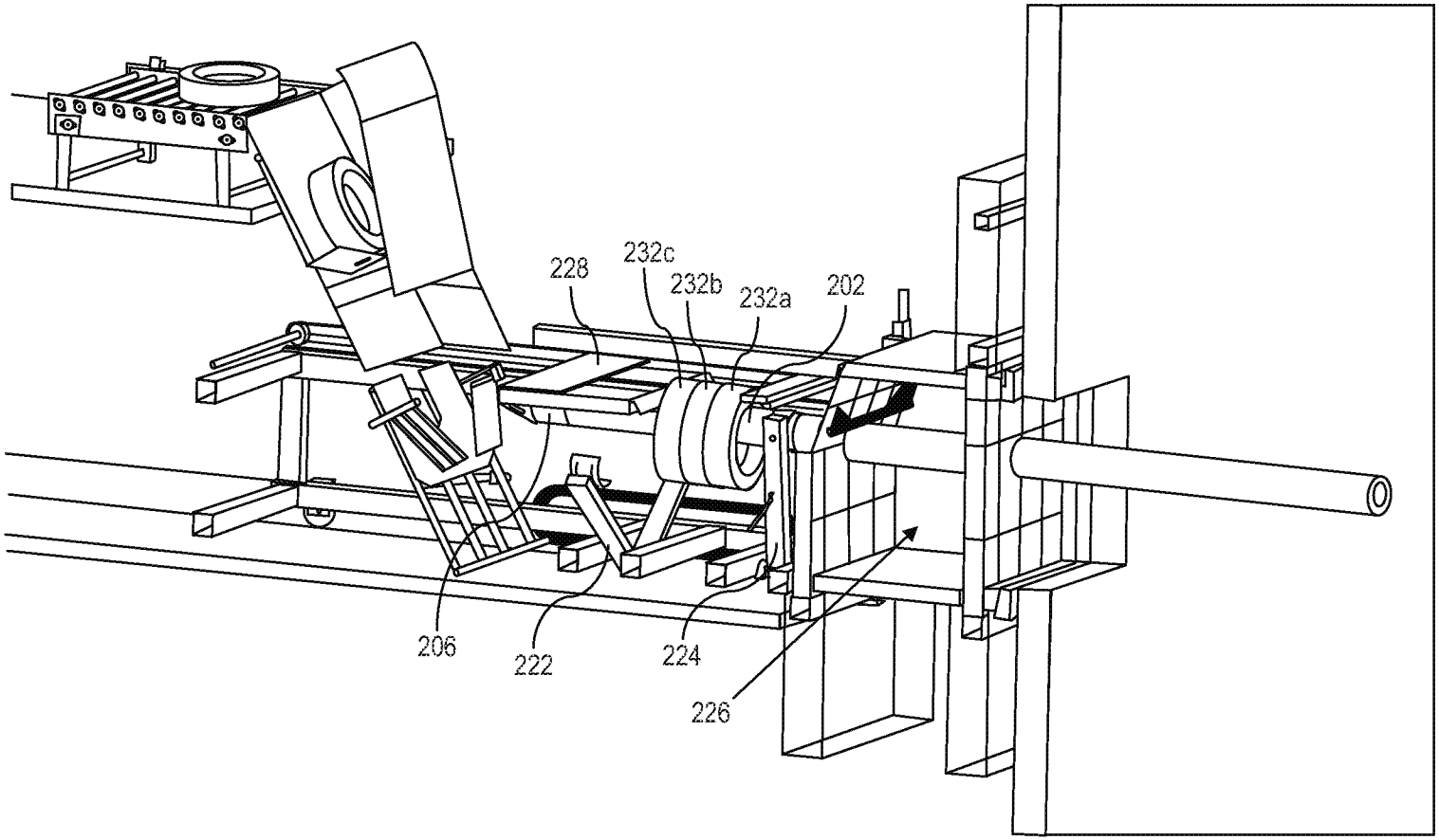

Referring to FIG. 5, a first clamp 222, which supports the first end 206 of the skewer rod 202, is controlled to open up, releasing the skewer rod 202. Then, the first plow 228 pushes the three tires 232*a-c* along the length of the skewer rod 202 past the opened first clamp 222 but before a closed second clamp 224 that defines a second portion of the skewer rod 202. Thus, the second portion of the skewer rod 202 is located just before the airlock 226. In other words, the first plow 228 reciprocates substantially longitudinally in cooperation with the skewer rod 202 to advance tires 232*a-c* along at least a portion of the length of the skewer rod 202. Thus, the three tires 232*a-c* are just outside the airlock 226. Alternatively, as described more fully herein, the gate 220 can function in cooperation with or as an alternative to the plow 228 so as to push tires along the skewer rod 202.

Figure 6:
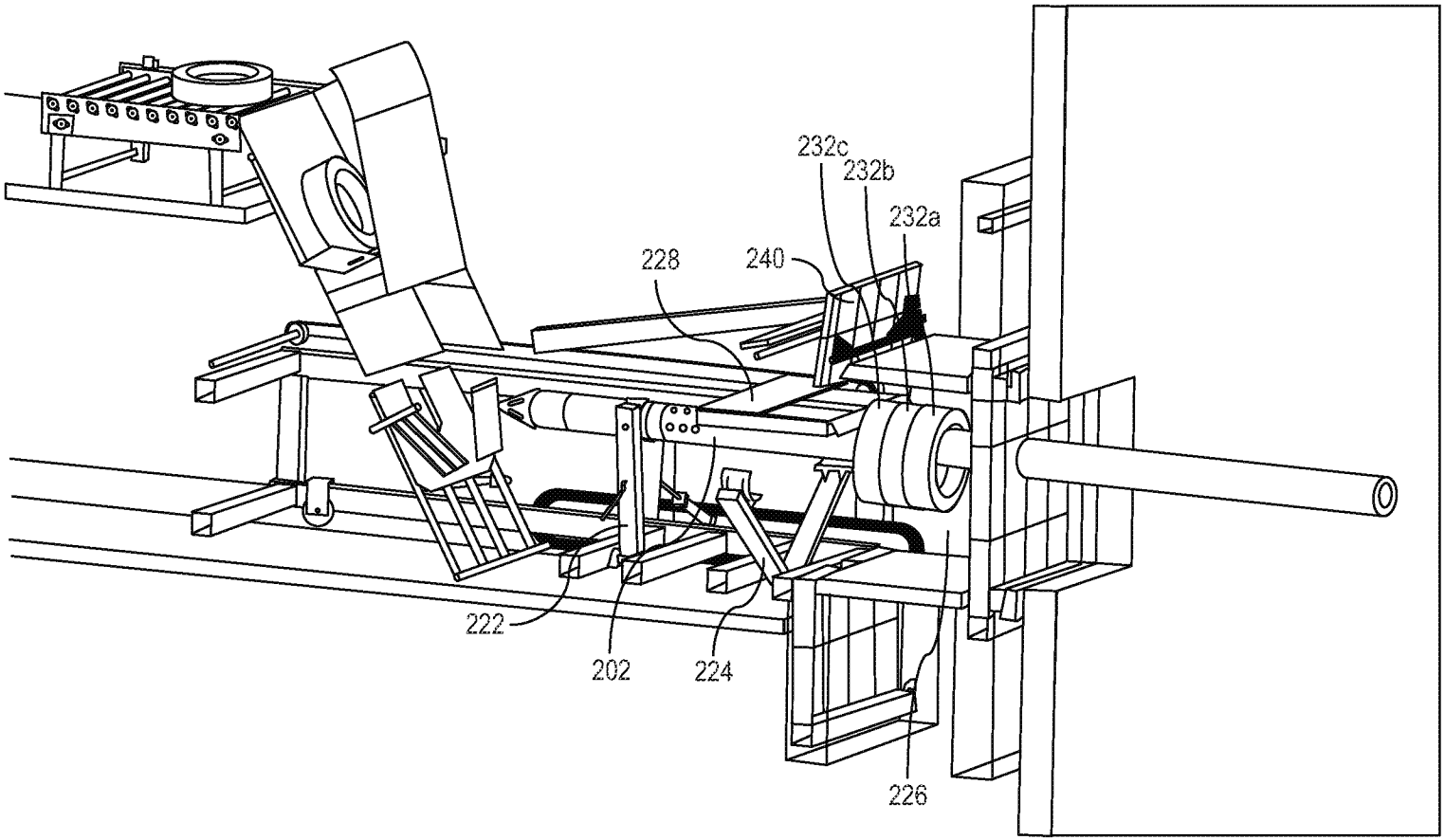

Referring to FIG. 6, the first clamp 222 closes and supports the skewer rod 202, and the second clamp 224 opens up, releasing the skewer rod 202. Further, a first gate 240 to the airlock 226 opens, and the first plow 228 pushes the tires 232*a-c* into the airlock 226. The first plow 228 returns to its starting position, and the first gate 240 to the airlock 226 closes.

Figure 7:
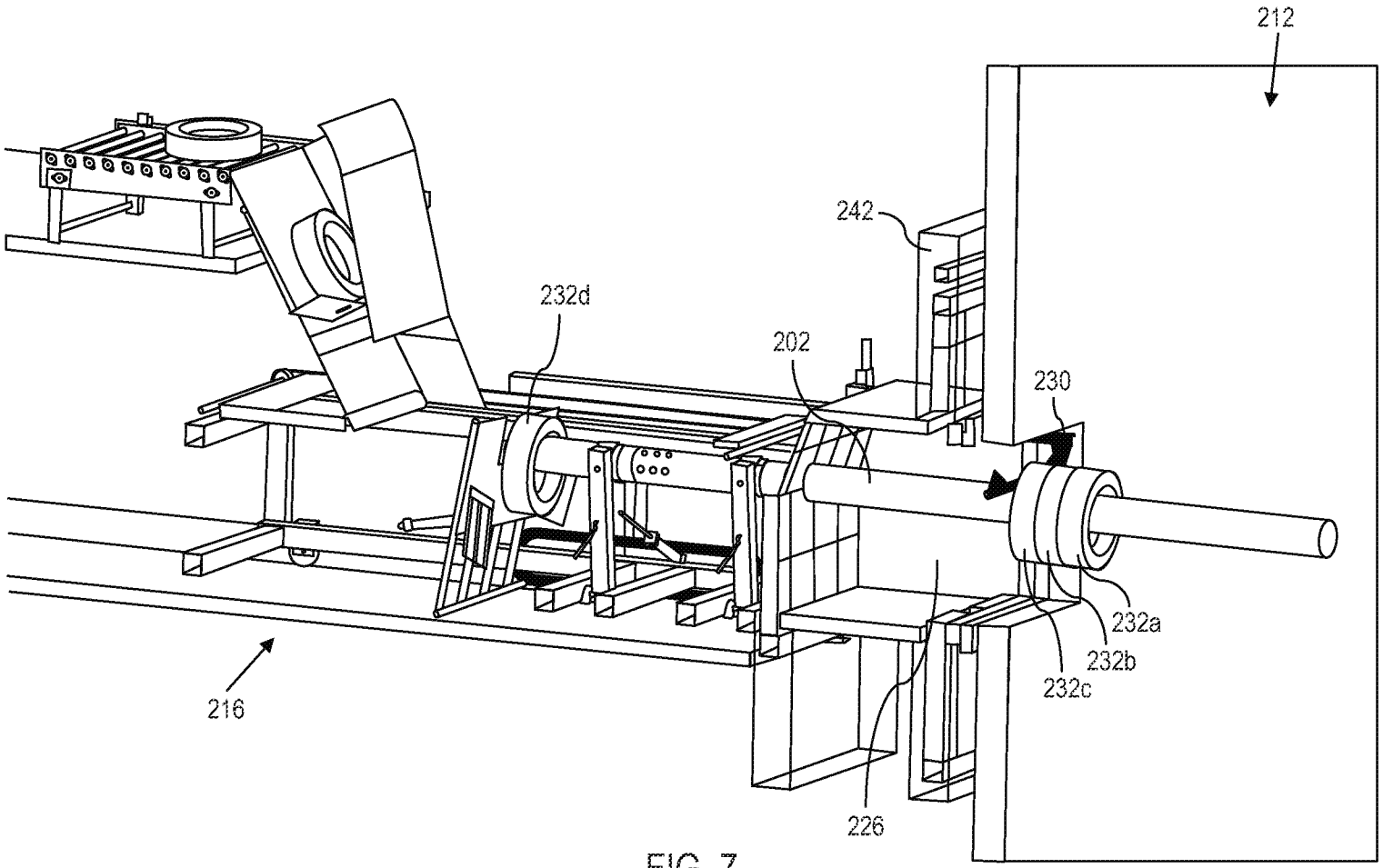

Referring to FIG. 7, a second gate 242 from the airlock 226 opens and the second plow 230 pushes the tires 232*a-c* along the skewer rod 202 to the free end of the skewer rod in the fuel burning zone 212. Further, more tires 232*d* may be loaded on the skewer rod 202 by the loading area 216 during this time, but it is not required. As such the process repeats in serial or parallel, pipelined or otherwise, to load more solid fuel 232 into the fuel burning zone 212. The weight of the tires can be used to determine the rate at which the tire groups are loaded into the fuel burning zone 212.

The illustrative, non-limiting example sequence herein illustrates three tires per group; however, other group sizes can be utilized. This is done to minimize the cycling requirements of the skewer gates and clamps. Moreover, the group size need not be consistent for each iteration. For example, large truck tires may pass through by themselves, whereas small car tires can go through in groups. Another example could be two 14 kg tires may comprise a load (instead of three 9 kg tires illustrated in the example), and so on.

After the tires burn, a wire from the tire is left over. As tires are pushed onto the skewer, the remaining tire wire falls down into the feed shelf. For instance, as illustrated, as more tires are advanced onto the skewer rod, the remaining unburned tire wire is pushed off the end of the skewer rod where it falls to the feed shelf and into the kiln, where it melts to become part of the clinker.

As a non-limiting example, the skewer rod is hydraulically powered with a 22 to 30 kW pumping unit. This includes an accumulator tank to enable continued operation during a power loss and allow all clamps and gates to close for safe operation.

Figure 8:
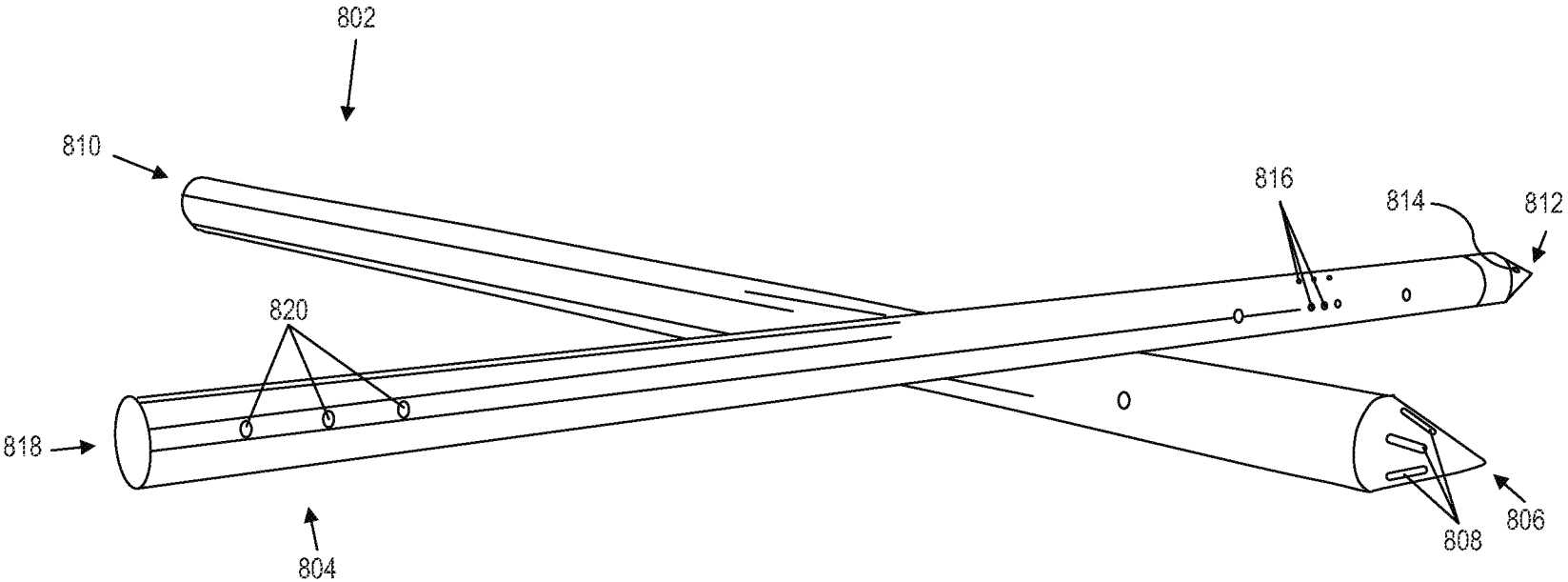
FIG. 8 is a view of skewer rods for a solid fuel skewer suspension burning system, according to aspects of the present disclosure.

Referring to FIG. 8, two different skewer rods 802, 804 are illustrated, according to aspects of the present disclosure. Either of the skewer rods (open skewer rod 802, capped skewer rod 804) may be used in any system disclosed herein as the skewer rod (102, FIGS. 1 and 202, FIGS. 2-7). The open skewer rod 802 includes a conical end 806 that includes vent holes 808. The other end of the open skewer rod 802 is open. Thus, the open skewer rod 802 is a hollow tube. When placed in a system (100 of FIG. 1, 200 of FIGS. 2-7, 1100 of FIG. 11) there is a pressure differential between the end in the fuel burning zone (112, FIG. 1, 212, FIGS. 2-7) and the end that is not in the fuel burning zone such that air is drawn from the end not in the fuel burning zone to the end that is in the fuel burning zone. In an SEL system, air is drawn in through the vent holes 808 of the conical end 806 and expelled from the open end 810. In a UEL system, air is drawn from the open end 810 and expelled through the vent holes 808 of the conical end 806.

The capped skewer rod 804 also includes a conical end 812 with vent holes 814. Further, the exemplary capped skewer rod 804 includes supplementary vent holes 816 along the capped skewer rod 804. The supplementary vent holes 816 are not required on either skewer rod 802, 804. However, the supplementary vent holes 816 may included in some embodiments of the open skewer rod 802 or the capped skewer rod 804 as the application dictates. The capped skewer rod 804 further includes a capped end 818 and out-flowing vent holes 820. The number of out-flowing vent holes 820 may vary, and can be located in any desired location on the skewer rod 804. For example, the exemplary capped skewer rod 804 includes three out-flowing vent holes 820 on one side of the skewer rod 804 and three out-flowing vent holes (not shown) on the other side (i.e., the holes are located at 3 o'clock and 9 o'clock on the circumference of the skewer rod 804). The three out-flowing vent holes of the exemplary capped skewer rod 804 are one inch (approximately 2.54 centimeters) in diameter and spaced two feet (approximately 6.1 meters). When used in an SEL system (and possibly in a UEL system depending upon the implementation) air is drawn in through the vent holes 814 (and supplementary vent holes 816 if present), and because other end is capped 818, the air is expelled through the out-flowing vent holes 820. As the tires hang on the skewer rod 804, the air is supplied to the tires internally from the out-flowing vent holes 820. As such either skewer rod 802, 804 can be used to supply oxygen to the fuel burning area to improve the rate at which the tires burn in the fuel burning zone. In certain illustrative examples, it is possible to pump oxygen from a supply (not shown) into the hollow of the skewer rod so that oxygen escapes the out-flowing vent holes (or end of the skewer rod) to further increase the burn rate of tires.

The skewer rods 802, 804 must be able to survive anticipated gas temperatures of 900° C. to 1100° C. As such, according to an exemplary implementation of the present disclosure, the skewer rod 802, 804 comprises a centrifugally spun casting made of Super 22H, a Duraloy Technologies alloy rated for 1200° C.

Figure 9:
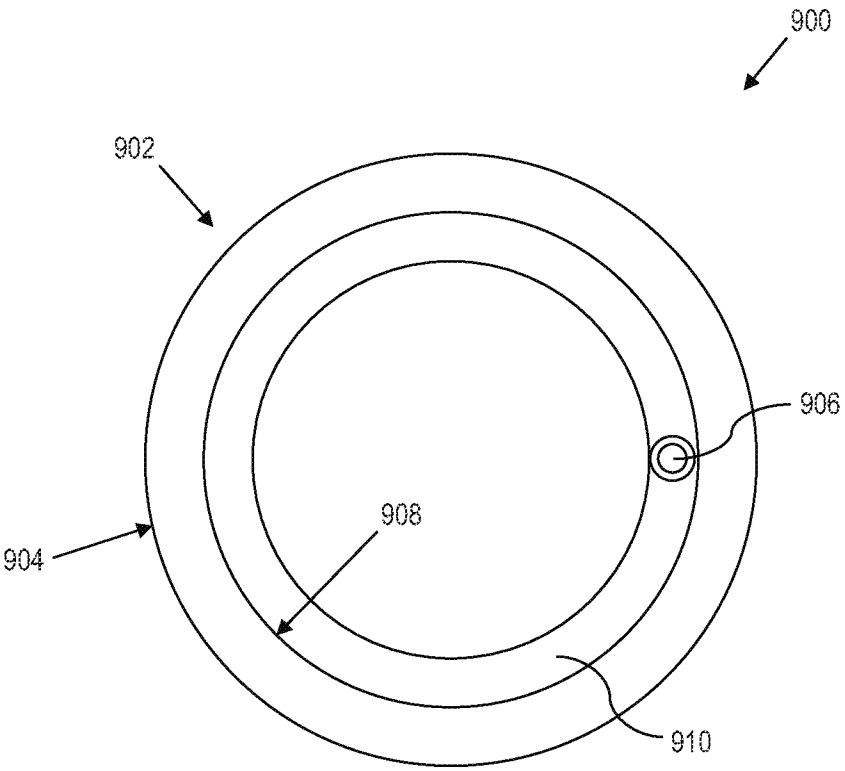
FIG. 9 is an end view of a skewer rod for a solid fuel skewer suspension burning system, according to aspects of the present disclosure.

Super 22H is a proven material and is commonly used for the most severe application of mid kiln feed tubes, which typically operate in gas temperatures in excess of 1100° C. for periods of 12 months and longer. According to aspects of the present disclosure, the skewer rod is comprised of Super 22H that is centrifugally spun, thus the casting quality is high. Centrifugal castings are spun at high speeds during the casting process. The centrifugal force literally "squeezes" molten metal into shrinkage voids as the casting is formed. The resulting casting is thus very dense, especially when compared to a static casting. The centrifugal force also spins the more dense material (the metal) to the outside diameter of the molten casting. The less dense material (the dirt, dross, or slag) is left behind to the inside diameter, where it can be removed by machining, which leaves a very clean, very dense, end product. Referring to FIG. 9, a section view of a skewer rod 900 is illustrated (either skewer rod 802, 804 from FIG. 8). The skewer rod is basically a hollow pole 902. For instance, in an exemplary implementation, the outside diameter 904 of the skewer rod 900 is approximately 257 mm, the wall thickness is approximately 25 mm, and a thermocouple 906 is attached to the inside wall 908 to monitor temperatures.

According to various aspects of the present disclosure, optional manual or automatic damper(s) 910 can be added to the skewer rod, e.g., to control outside ambient airflow into and through the skewer rod to provide a means to cool the skewer rod and to prevent damage to the skewer rod 900. Additionally, the damper is configured to automatically close in response to positive pressure in the stationary heat transfer station of the kiln.

Figure 10:
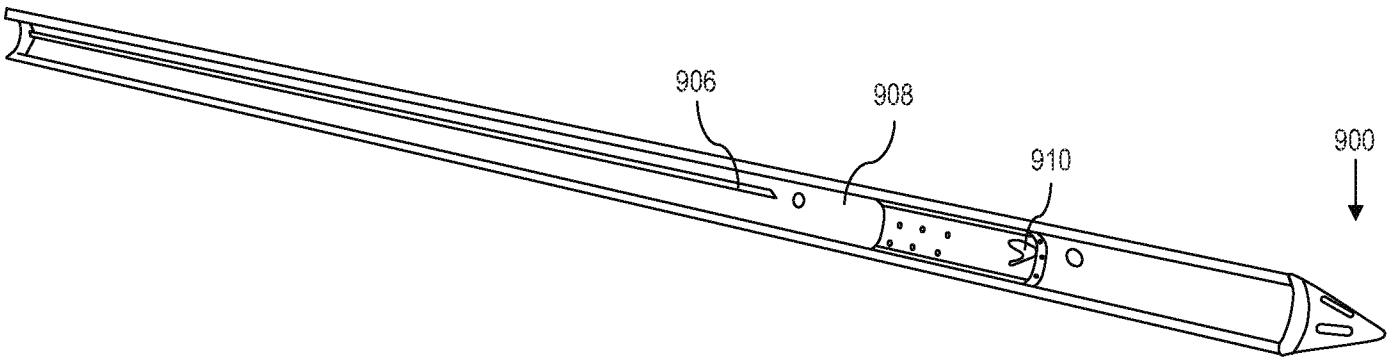
FIG. 10 is a view of a skewer rod for a solid fuel skewer suspension burning system, according to aspects of the present disclosure.

Referring to FIG. 10, as noted above, at least one thermocouple 906 is utilized to monitor the temperature of the skewer rod 900. By way of illustration, and not by way of limitation, in the example of FIG. 10, a thermocouple 906 is attached to the inside wall 908 of the skewer for temperature monitoring. In the event that an abnormally high temperature is detected by the thermocouple 906, the skewer rod 900 is retracted from the calciner. Additionally, an adjustable butterfly damper 910 in the skewer rod enables a controlled amount of cooling air to pass through the skewer rod 900. The damper 910 is designed to close in the event of positive kiln pressure. The amount of cooling air, if needed, can be up to 70 standard cubic meters per minute.

Figure 11:
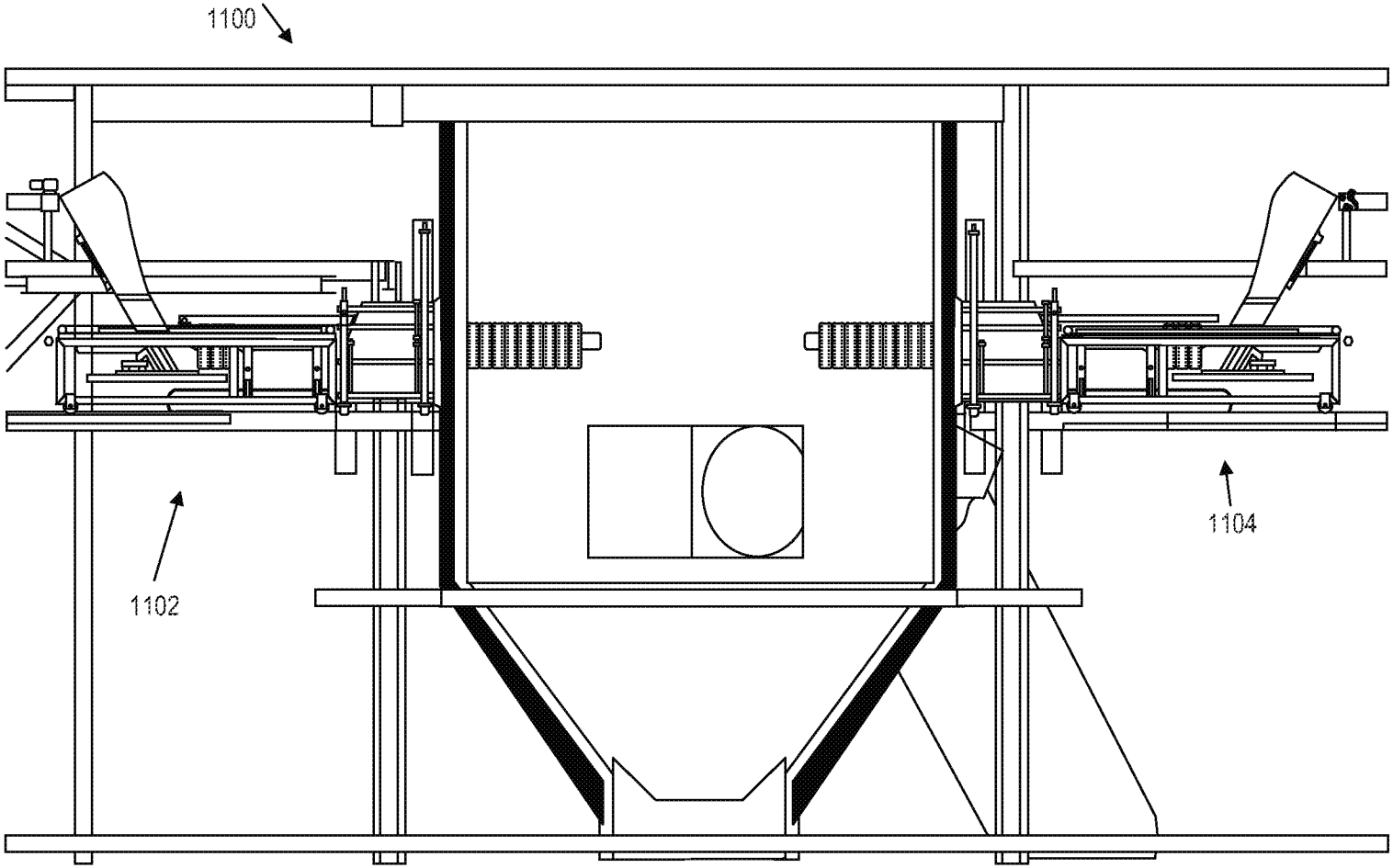
FIG. 11 is a view of a dual skewer system, according to aspects of the present disclosure.

Referring to FIG. 11, a solid fuel delivery skewer system 1100 is illustrated according to further aspects of the present disclosure. In the illustrative implementation, a two-skewer tire fuel feed system is implemented using two instances of the SEL design described more fully herein with reference to FIGS. 2-7. This configuration may burn up to eight tons of whole tire fuel per hour using the two skewer systems 1102, 1104. The skewers are located just above the tertiary air ducts as illustrated.

According to various aspects of the present disclosure, in addition to those parts described above, a turnkey system may include system components including: a Trailer Tipper, a Live Bottom Hopper, a Tire Separator, an Inspection/Rejection System, Inclined Belt Conveyor, tow skewer burners and Tower Conveyors and electrical controls.

The systems may also optionally feed a second alternative fuel of pelletized RDF (refuse derived fuel), e.g., to a location in the riser duct.

Thus, according to various aspects of the present disclosure, tire derived fuel is utilized to lower operational costs of the kiln. The burning of tire derived fuel further provides environmental benefits, such as providing for the disposal of used tires. Moreover, by using the skewer system described more fully herein, preheater kilns and precalciner kilns can burn a significant amount of tires, e.g., 30-50% of the consumed fuel without the traditional severity of problems with sulfur buildup, etc.

In precalciner kilns, whole tire fuel co-processing has not yet reached its full potential. Substitution rates have typically been limited to a range of 2% to 10% using conventional methods, due to excessive sulfur buildup. Notably, precalciner kilns have low levels of oxygen at the inlet of the kiln where the tires burn or gasify. The gas and material temperatures are much higher at this same location. These two conditions cause much greater localized reducing conditions when tires are fed to the inlet of a precalciner kiln. These conditions, combined with an extension of the sulfur cycle into the calciner, contribute to an increase in unmanageable sulfur buildup in the riser and feed chutes and ultimately low tire fuel feed rates.

However, according to aspects of the present disclosure herein, skewer system suspension burning can be utilized to maximize both the substitution rates and the $N_x$ reduction capability. Moreover, the skewer rod described more fully herein, holds the tires in suspension in the calciner, thus decreasing localized reducing conditions and increasing tire fuel feed rates.

Further, the use of the skewer rod allows maximizing the amount of tires that can be inserted into the precalciner. Moreover, the skewer rod provides suspension stability. If the burner is placed in upwardly moving high velocity gas, such as in the riser duct and some calciners, the tires will tend to lift. For instance, the high upward gas velocities, likely in the range of 30 to 35 m/s (70 mph) can lift a tire as it burns. However, the skewer rod prevents the tires from lifting off the rod and further prevents tires from tumbling down to the kiln.

Having thus described the invention of the present application in detail and by reference to embodiments thereof, it will be apparent that modifications and variations are possible without departing from the scope of the invention defined in the appended claims.

What is claimed is:

1. A solid fuel skewer suspension burning system for a kiln, the system comprising:

a skewer rod having a free end and a length that extends longitudinally;

a skewer positioner that extends and retracts the skewer rod; and a solid fuel loading system having a fuel centering and staging area and a fuel loading area; wherein:

the fuel centering and staging area receives solid fuel from an associated conveyor system; and the fuel loading area receives solid fuel from the fuel centering and staging area, whereupon fuel is loaded onto the free end of the skewer rod at the fuel loading area.

2. The system according to claim 1 further comprising:

a dislodging mechanism coupled to the skewer positioner, wherein the dislodging mechanism dislodges solid fuel from the skewer rod when the skewer positioner retracts the skewer rod.

3. The system according to claim 1, wherein the skewer positioner is located on an opposite side of a fuel burning zone from the solid fuel loading system.

4. The system according to claim 1, wherein:

the fuel centering and staging area connects to the conveyor system to receive solid fuel in the form of tires; and the fuel centering and staging area comprises a passageway that passes each received tire from the conveyor system to the fuel loading area.

5. The system according to claim 4, wherein:

the fuel centering and staging area is positioned above the fuel loading area; and the passageway drops each received tire down into the fuel loading area;

wherein:

the fuel loading area receives each tire such that a hole in the center of each tire aligns with the free end of the skewer rod.

6. The system according to claim 1, wherein:

the solid fuel comprises tires;

further comprising:

an actuated gate that cooperates with the fuel loading area to push a tire received into the fuel loading area onto the free end of the skewer rod.

7. The system according to claim 1, wherein:

the skewer rod spans entirely across a fuel burning zone of the kiln to which the solid fuel skewer suspension burning system is installed.

8. The system according to claim 1, wherein:

the skewer rod is a hollow tube that is rated for at least 1200° C.

9. The system according to claim 8, wherein:

the skewer rod further comprises a butterfly damper that provides a controlled amount of cooling air to pass through the skewer rod; and the damper automatically closes in the event of positive kiln pressure.

10. The system according to claim 8 further comprising:

a thermocouple that measures a temperature of the skewer rod; and a controller;

wherein the controller controls the skewer positioner to retract the skewer rod from a fuel burning zone in response to a temperature measured by the thermocouple exceeding a predetermined threshold.

11. A solid fuel skewer suspension burning system for a kiln, the system comprising:

a skewer rod having a free end and a length that extends longitudinally, wherein:

the skewer rod is a hollow tube that is rated for at least 1200° C.;

the skewer rod further comprises a butterfly damper that provides a controlled amount of cooling air to pass through the skewer rod; and the damper automatically closes in the event of positive kiln pressure;

a solid fuel loading system having a fuel centering and staging area and a fuel loading area; wherein:

the fuel centering and staging area receives solid fuel from an associated conveyor system; and the fuel loading area receives solid fuel from the fuel centering and staging area, whereupon fuel is loaded onto the free end of the skewer rod at the fuel loading area.

12. The system according to claim 11, wherein:

the fuel centering and staging area further comprises a platform that a single tire at a time rests upon, which is positioned generally above the fuel loading area; and the fuel loading area receives tires from the fuel centering and staging area, one tire at a time.

13. The system according to claim 11, wherein:

the fuel loading area comprises a gate having a pair of flaps that receive fuel in the form of tires from the fuel centering and staging area;

the pair of flaps vertically position each tire for loading onto the skewer rod; and the gate pivots to advance each tire from the fuel loading area onto the skewer rod.

14. The system according to claim 11 further comprising:

a thermocouple that measures a temperature of the skewer rod;

a skewer positioner that extends and retracts the skewer rod; and a controller;

wherein the controller controls the skewer positioner to retract the skewer rod from a fuel burning zone in response to a temperature measured by the thermocouple exceeding a predetermined threshold.

15. The system according to claim 11, wherein the skewer rod includes apertures from a surface to the hollow so as to allow oxygen to flow to an inside portion of a tire suspended from the skewer rod.

16. The system according to claim 11, further comprising a controller coupled to the solid fuel loading system and the conveyor, the controller operatively programmed to control the solid fuel loading system and the conveyor such that a rate that the conveyor feeds the fuel loading system is dynamically determined by a size of the fuel supplied to the fuel loading system.

17. A solid fuel skewer suspension burning system for a kiln, the system comprising:

a skewer rod having a free end and a length that extends longitudinally, wherein the skewer rod is a hollow tube that is rated for at least 1200° C.;

a thermocouple that measures a temperature of the skewer rod;

a skewer positioner that extends and retracts the skewer rod; and a controller;

a solid fuel loading system having a fuel centering and staging area and a fuel loading area; wherein:

the fuel centering and staging area receives solid fuel from an associated conveyor system; and the fuel loading area receives solid fuel from the fuel centering and staging area, whereupon fuel is loaded onto the free end of the skewer rod at the fuel loading area;

wherein:

wherein the controller controls the skewer positioner to retract the skewer rod from a fuel burning zone in response to a temperature measured by the thermocouple exceeding a predetermined threshold.

18. The system according to claim 17, wherein:

the fuel centering and staging area further comprises a platform that a single tire at a time rests upon, which is positioned generally above the fuel loading area; and the fuel loading area receives tires from the fuel centering and staging area, one tire at a time.

19. The system according to claim 17, wherein:

the fuel loading area comprises a gate having a pair of flaps that receive fuel in the form of tires from the fuel centering and staging area;

the pair of flaps vertically position each tire for loading onto the skewer rod; and the gate pivots to advance each tire from the fuel loading area onto the skewer rod;

wherein:

the controller is coupled to the solid fuel loading system and the conveyor, the controller operatively programmed to control the solid fuel loading system and the conveyor such that a rate that the conveyor feeds the fuel loading system is dynamically determined by a size of the fuel supplied to the fuel loading system.

20. The system according to claim 17, wherein the skewer rod includes apertures from a surface to the hollow so as to allow oxygen to flow to an inside portion of a tire suspended from the skewer rod.

* * * * *